US005145278A

United States Patent [19]

Lohrmann

[11] Patent Number: 5,145,278

[45] Date of Patent: Sep. 8, 1992

[54] MODULAR STEEL BRIDGE AND TRAFFIC BARRIER AND METHODS OF FABRICATION AND APPLICATION THEREFOR

[76] Inventor: Manfred Lohrmann, 141 Ardmore St., Wexford, Pa. 15090

[21] Appl. No.: 722,346

[22] Filed: Jun. 27, 1991

[51] Int. Cl.[5] ..... E01F 13/00

[52] U.S. Cl. ..... 404/6; 14/73; 256/13.1; 404/73

[58] Field of Search ..... 404/6–9, 404/72, 73; 14/73; 256/13.1

[56] References Cited

U.S. PATENT DOCUMENTS 4,553,875 11/1985 Casey ..... 404/6

4,666,332 5/1987 Burgett ..... 404/6

4,946,306 8/1990 Yodock ..... 404/6

4,964,750 10/1990 House et al. ..... 404/6

*Primary Examiner*—Thuy M. Bui

*Attorney, Agent, or Firm*—Reed Smith Shaw & McClay

[57] ABSTRACT

A steel traffic barrier module is provided that is preferably formed a plurality of modified I-beams joined by connecting plates wherein the modified I-beams present on at least one side of the module a profile having a plurality of inclined surfaces corresponding substantially to that of a New Jersey barrier profile. A cover plate spans substantially the entire length of the module and establishes at least one of the inclined surfaces. The module may be anchored to a traffic surface including a highway surface or a bridge deck.

38 Claims, 6 Drawing Sheets

MODULAR STEEL BRIDGE AND TRAFFIC BARRIER AND METHODS OF FABRICATION AND APPLICATION THEREFOR

FIELD OF THE INVE

The present invention relates generally to steel barriers to be used in bridge and highway construction and, more particularly, to a modular steel bridge and traffic barrier, adapted for construction and connection to a bridge deck/superstructure or other supportive foundation.

BACKGROUND OF THE INVENTION

The primary purpose of traffic barriers in bridge and highway construction is to constrain moving vehicles within their travel direction. Barriers are significant safety devices for the guidance (redirection) of a vehicle upon impact due to an accident or a vehicle malfunction. When such barriers are present on bridges and other roadway structures, the moving vehicles cannot be readily driven off the bridge and become airborne, nor can they cross over into oncoming traffic.

Construction of traffic barriers for use along the edge and atop the bridge or roadway surface may involve cast-in-place reinforced concrete or precast elements which are mechanically connected to their respective support such as, for example, a deck or a wall. However, both of these methods are labor-intensive and require the use of special forms and in most cases increase the period of time for construction due to the concrete curing requirements.

The safety significance of the bridge barrier has been recognized by the American Association of State, Highway and Transportation Officials (AASHTO) as evidenced by their 1989 publication entitled "GUIDE SPECIFICATIONS FOR BRIDGE RAILINGS", which are expected to become construction industry standards, possibly as early as 1993. These proposed specifications are, on average, much more demanding than existing standards in terms of the expected level of safety which must be capable of being provided by bridge railing and similar traffic barriers.

Basic traffic barriers separating two lanes of vehicular traffic are known in the art. U.S. Pat. No. 3,678,815 issued to Younker, for example, discloses a concrete traffic barrier which may be used in forming bridge guard rails, median barriers, and the like. The Younker barrier includes a pair of identically shaped shells which are bolted together leaving a void into which concrete is poured to form a core of solid material. U.S. Pat. No. 4,435,106 issued to Forster et al. discloses a traffic barrier which may be used to separate a roadway. The Forster traffic barrier may be cast-in-place through the use of forms to construct a solid concrete barrier which rises from the roadway edge outwardly first gently and then more strongly and then spaced below an overhanging guiding mechanism. A steep convex rise follows the gentle rise and transfers under the guiding mechanism into a flattened area.

Combining steel and concrete in a traffic barrier was disclosed in U.S. Pat. No. 4,496,264 issued to Casey. Casey discloses a barrier structure comprised of a number of spaced-apart, in-line vertical I-beam sections embedded in a roadway and having secured to the I-beams a number of form plates having a pair of downwardly and outwardly diverging pair of legs and a pair of upwardly diverging extending arms. Reinforcing rods are extended through aligned holes in the plates and side panels are connected to the panels. Concrete is poured down through the open top of the structure completely encasing the I-beams, panels, and reinforcing rods. The concrete bonds the side panels and a capping piece is pressed down into the concrete to form the steel and concrete traffic barrier.

Constructing concrete traffic barriers with precast concrete was first patented by Smith in U.S. Pat. No. 4,059,362. Smith discloses a highway traffic barrier composed of precast reinforced concrete barricades which are joined together. The alignment with each barricade is accomplished through the use of a horizontally and vertically tapered, vertical tongue-and-groove arrangement. This tongue-and-groove arrangement is molded onto the ends of each barricade with the wider portion of the taper at the bottom to facilitate the removal of one piece of the traffic barrier within an installation. The Smith barricade though is designed to be a highway median barricade and cannot be secured to a retaining wall.

A precast barrier design which can be used on retaining walls is disclosed in U.S. Pat. No. 4,494,892 issued to Wojciechowski. This design makes use of an interior channel of the barrier which directly contacts the top edge of the retaining wall. The projecting anchoring rods extend either transversely into a lateral precast concrete apron under the roadway surface or downwardly into the earthen support of the roadway. These projecting anchoring rods provide the support to withstand impacts from moving vehicles.

A method of construction in joining a precast concrete traffic barrier to a retaining wall is disclosed in U.S. Pat. No. 4,964,750 issued to House et al. This design provides for a profiled reinforced concrete block with a longitudinal channel void along its bottom surface. This barrier element will slide and rest on top of the retaining wall. U-shaped anchoring bars protrude from the precast barrier and the top of the retaining wall. A locking bar is inserted through the opening provided by the opposite U-shaped bars. Seating material is inserted through an opening in the barrier into the keyway, followed by grouting of the keyway.

Another known precast traffic barrier is U.S. Pat. No. 4,348,133 issued to Trent disclosing a precast polymer concrete shell which is placed at the construction site then filled with hydraulic concrete or other ballast through filling holes on top of the shell. However, the shell cannot be placed on a retaining wall since the shell must be entirely placed on the road or bridge surface.

A method of joining precast concrete barriers on substantially flat roadway surfaces is disclosed in U.S. Pat. No. 4,605,336 issued to Slaw. This design uses an upwardly projecting inverted U-shaped rod, which must be inserted into a narrow longitudinal channel, and a concrete reinforcing rod extending axially through the channel forms a longitudinal locking bar inserted to lock the barrier to the retaining wall. One problem with this design is that it can only be used on a substantially flat roadway and the alignment of the precast barrier and roadway must be precise to insure that the U-shaped rods are inserted into the rectangular inserts. Another limitation is a lack of tongue and groove connection to secure the barrier in place.

A serious drawback of conventional bridge or traffic barrier constructions is that their major structural material component, concrete, is heavy, costly and, absent substantial steel reinforcement, relatively limited in lateral impact resistance. And, as would be expected, the weight, cost and size of these predominantly concrete barriers increase as their specified minimum safety requirements also increase. Hence, as AASHTO and/or other municipal construction specifications for these barriers become increasingly demanding, so too will the costs of manufacturing, storing, handling and installing such barriers.

Therefore, the need for a traffic barrier able to meet increasingly demanding regulatory specifications and a more efficient method of manufacturing such a barrier is evident.

SUMMARY OF THE INVENTION

The present invention provides a modular bridge and roadway traffic barrier comprised of structural rolled steel components and steel anchoring devices all joined by welding. The barrier may extend longitudinally along and generally parallel to the outside of edges of bridges, retaining walls and other parts of highways both elevated and at-grade, and it may serve as a median barrier. Its surface or profile facing the side of traffic is sloped away from the traffic at varying angles so as to resemble the shape of the class of barriers commonly known as "New Jersey" barriers. The barrier is formed of at least one although preferably two or more modified steel I-beams, the webbing of which serves as an inclined, near vertical face surface for the barrier. Its bottom part is preferably partially embedded in concrete such as a road surface, a bridge deck, reinforced concrete components, or the like, whereby the barrier is firmly anchored into the road surface, bridge deck superstructure or other structural component so as to be able to withstand the impact forces of a crashing vehicle and redirect the impacting vehicle. This anchorage is accomplished by various arrangements of steel anchoring components which is dependent of the various structural supports. As an alternative to embedding the barrier in concrete, direct bolting of the barrier to structural support steel, as in a bridge superstructure, for example, is but another possible anchorage method.

The barrier may be of various heights and it is adaptable to a variety of conditions, e.g., it can be anchored to surfaces which are not horizontal.

In addition to the description of a modular traffic barrier, the present invention relates preferred methods for manufacture of such barriers and efficient methods for connecting the barriers to a bridge superstructure or other highway structures, e.g., retaining walls and structural components or foundations.

In a preferred embodiment of the invention the steel traffic barrier is formed of a plurality of modified, commercially available steel I-beams the webbings of which are inclined to form the major face surface of the barrier and which are joined by plates welded to the I-beams to form a modular barrier of simple construction and minimized fabrication cost. The simplified construction of the barrier enables it to be easily installed in virtually any orientation between and including vertical and horizontal.

The smooth steel traffic facing surfaces of the barrier of the present invention serve to minimize the friction factor between impacting vehicles and the barrier, hence resulting in a reduction in the rate of deceleration of the impacting vehicles, as compared to conventional concrete New Jersey barriers, and enhancing the barrier's capacity to redirect the impacting vehicles in the direction of traffic.

The barrier's weight is less than that of a similar barrier formed of reinforced concrete which can result in substantial savings in new highway constructions wherein the use of vehicular barriers is mandated, particularly in bridge construction.

The barrier of the present invention is much more rapidly manufactured than precast or cast-in-place concrete barriers due to elimination of the curing period, generally at least twenty-eight days, which is required in the construction of concrete barriers. Moreover, no grout is required for its installation as in the installation of precast barriers.

The presently disclosed steel traffic barrier enables simplification of connection and transition between the barrier and adjacent highway guide rails while providing a barrier which is narrow at its base, whereby the design width of a bridge or roadway to be constructed can be minimized, hence conserving construction materials and reducing construction costs.

The present invention provides traffic barriers comprising modified I-beams which resist crash loadings in bending about the weaker direction, i.e., the webbing, of the I-beam. Further in accordance with the present invention, it is simple to manufacture traffic barriers of predetermined strengths, as required by design, merely by appropriate selection, modification, and assembly of commercially available steel I-beams of known design strength.

Other details, ob3ects and advantages of the present invention will become apparent as the following description of the presently preferred embodiments and presently preferred methods of practicing the invention proceeds.

BRIEF DESCRIPTION OF THE DRAWINGS

The invention will become more readily apparent from the following description of preferred embodiments thereof shown, by way of example only, in the accompanying drawings, wherein:

FIG. 1 is a cross sectional view of one embodiment of a modular steel traffic barrier manufactured in accordance with the present invention shown anchored adjacent to the edge of a traffic surface such as a bridge deck, a highway, or the like;

DETAILED DESCRIPTION OF THE PREFERRED EMBODIMENTS

Figure 1:
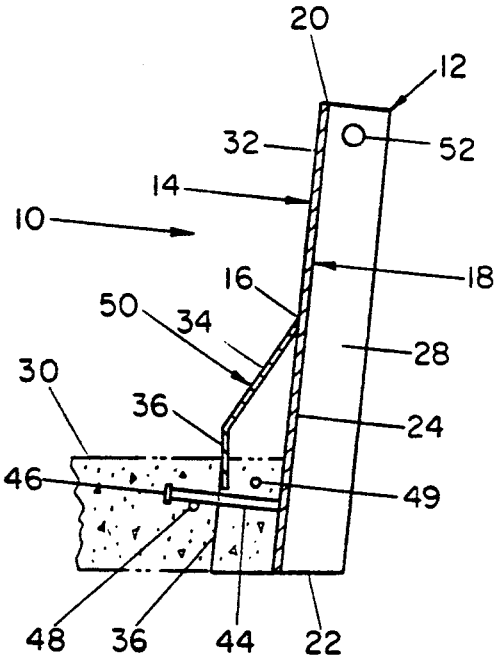

With reference to FIG. 1, a first preferred embodiment of the modular steel traffic barrier module 10 according to the present invention is depicted. Barrier module 10 includes at least one generally upright, slightly inclined section of steel 12 with one side 14 facing traffic which, at a point 16, generally intermediate the height of the module 10, branches toward the side of traffic. Whereas, the opposite surface 18, i.e., the surface facing away from traffic, continues at constant slope downwardly from the top surface 20 of the barrier element to the bottom surface 22 thereof.

Each section 12 is most preferably formed from an appropriately modified conventional and commercially available steel I-beam including a central spine or webbing plate 24 with perpendicular integral stiffening plates 26, 28 (see also FIG. 2) provided along the opposite edges of the webbing plate 24. The portions of the stiffening plates at the traffic facing side 14 are cut by suitable means, such as an acetylene torch, a laser beam, or equivalent steel cutting means, to impart to the traffic facing side 14 of section 12 a contour corresponding substantially to that of a New Jersey barrier.

The New Jersey barrier profile is known for its ability to deflect or redirect impacting moving vehicles toward the longitudinal direction of traffic surface 30, which may suitably take the form of a roadway, a bridge deck, an industrial manufacturing plant floor surface, or the like.

The New Jersey barrier profile of the traffic facing side 14 includes an upper inclined surface 32, extending from the top surface 20 and sloping downwardly at a first acute angle with respect to a vertical plane. An intermediate inclined surface 34 extends from the upper inclined surface 32, starting at point 16, and slopes downwardly at a second acute angle which is greater than the first angle and which is established by the size and shape of the portions of the stiffening plates 26, 28 that are removed by cutting from the traffic facing side 14 of section 12. A lower inclined surface 36 at the forwardmost edges of the remaining portion of the stiffening plates in the traffic facing direction extends from the intermediate inclined surface 34 toward the bottom surface 22. The lower inclined surface 36 slopes downwardly generally vertically or at a third acute angle either less or equal than the first acute angle. This general profile is well reported in the existing literature. As will be later described, cover means, preferably in the form of an elongated bent plate, are provided for covering the exposed forwardmost edges of the stiffening plates 26, 28 and for defining surfaces 34 and 36.

Figure 2:
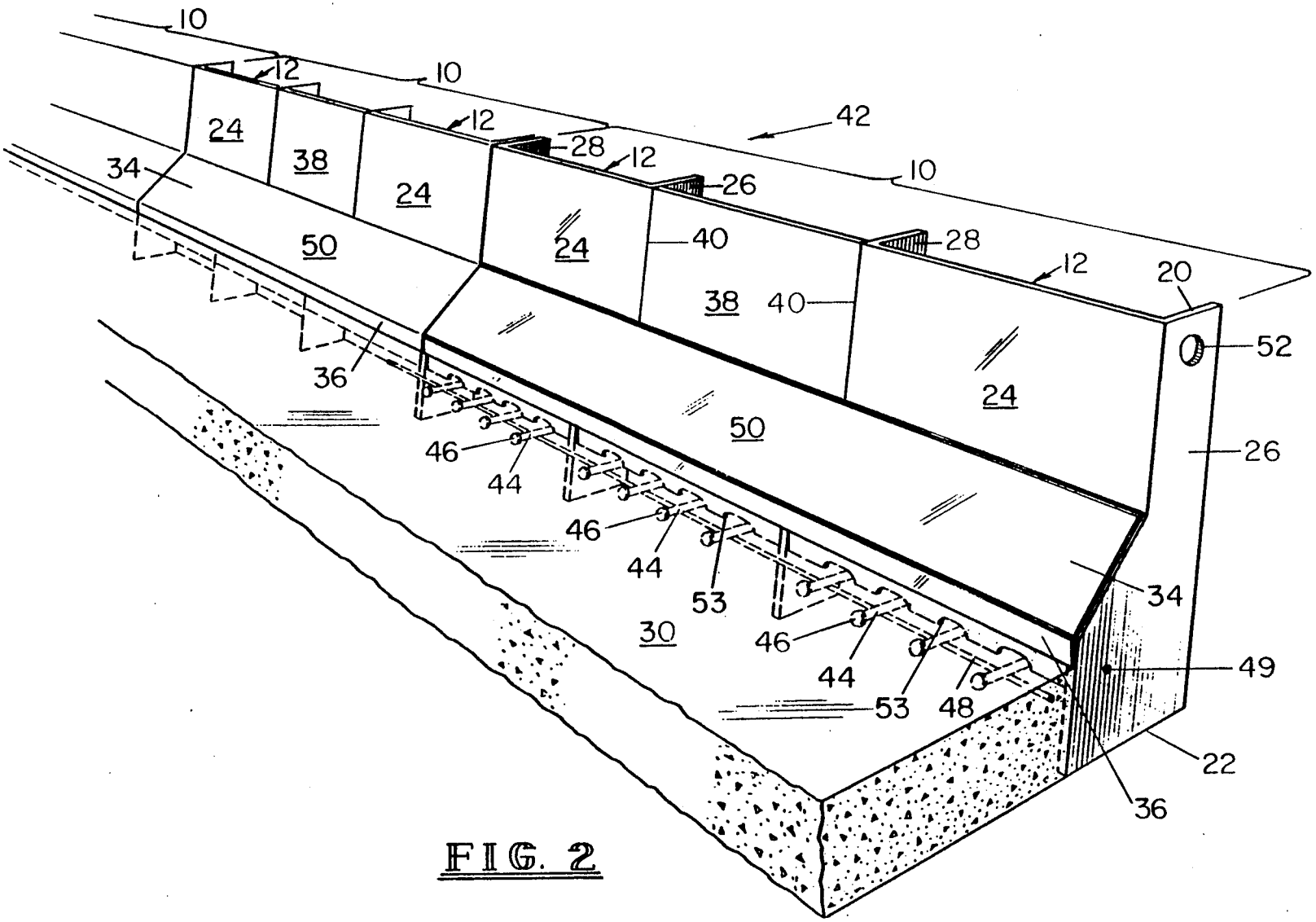
FIG. 2 is a perspective view of the traffic barrier of FIG. 1.

Turning now to FIG. 2, it is seen that the barrier module 10 is formed as a longitudinal module preferably comprised of at least two modified I-beams 12, which are joined by a connecting plate 38. Connecting plate 38 is preferably of the same height as the adjacent sections 12 and is welded at opposite generally vertically extending edges thereof to the appropriate stiffening plates 26, 28 along lines 40. It is preferred that the connecting plate 38 extend essentially coplanar with the webbing plates 24 of the adjacent modified I-beam sections 12 to which it is connected whereby its traffic facing side slopes at the same angle as and is flush with the upper inclined surfaces 32 of the adjacent sections 12 (which, in effect, are the traffic facing sides of the webbing plates 24 of the adjacent sections). The connecting plates 38 are preferably continuously welded from the top surface 20 to the bottom surface 22 of the adjacent sections 12. Moreover, the dimensions of the barrier module 10 can be easily varied to suit virtually any conceivable design specification. That is, by using different sizes and numbers of elements 12 and connecting plates 38, a barrier module 10 of virtually any desired length and/or height can be constructed. For example, the modules 10 shown in FIG. 2 can be extended in length by installing additional plates 38 and modified I-beams 12 in alternating fashion. It is also conceivable that as little as one modified I-beam 12 may be used to form module 10.

In the exemplary embodiment shown in FIG. 2, a plurality of modular steel traffic barrier modules 10 are shown supported along the edge of the traffic surface 30 to form a substantially continuous traffic barrier 42. Each modular steel barrier element typically has a length of approximately 9 feet, but can range in length from about 6 feet or less up to about 50 feet or more, depending on the specific design requirements of traffic surface 30. The modular steel traffic barrier 42 restrains a moving vehicle travelling on traffic surface 30 from crossing over the edge thereof and assists in redirecting the vehicle to the appropriate travel direction.

Anchoring means are provided for anchoring the barrier modules 10 to the traffic surface 30, including, but not limited to, a bridge deck, a roadway surface layer, or the like. In the embodiment of the present invention illustrated in FIGS. 1 and 2, the anchoring means comprise a plurality of anchoring bars 44 spaced apart from one another along the length of the barrier modules 10. Each of the anchoring bars 44 are fixedly secured at a first end thereof, as by welding, bolting, or the like, to webbing plate 24 and, if present, connecting plate 38. At their distal ends the anchoring bars are provided with enlarged heads 46 for firmly anchoring the bars against movement in the surrounding material, normally concrete, which forms the traffic surface 30. The anchoring means may also include a linking bar 48 extending generally parallel to the longitudinal axis of the barrier module 10 that is secured to the anchoring bars 44 and further serves to enhance anchorage of the modules to the traffic surface material. Further, adjacent modular elements 10 can be held in a desired alignment during installation by inserting a steel bar or bolts as required by design through aligned holes 49 in stiffening plates 26 and 28.

As mentioned hereinabove, the intermediate inclined surface 34 and the lower inclined surface 36 which form a substantial portion of the New Jersey barrier profile of the barrier module 10 are defined by a cover means. The preferred form of the cover means is that of an elongated steel plate 50 which extends for substantially the entire length of the barrier module and which is bent to conform to the shape of the forwardmost, i.e., traffic facing side, of the stiffening plates 26, 28, so as to be fixably secured thereto such as by welding. As is perhaps most clearly illustrated in FIG. 1, at the angular transition between the second and third acute angles defining the New Jersey barrier profile, the stiffening plates 26, 28 are notched in order to accommodate the lower inclined surface portion 36 of plate 50 so that the New Jersey profile is maintained according to specification. It is also contemplated that the single bent plate 50 may be replaced by two separate plates, one for forming the intermediate inclined surface 34 and another for forming the lower inclined surface 36, however, such a construction requires a greater expenditure of care and time for proper fabrication.

FIG. 2 also reveals that the lower edge of the lower inclined surface 36 of plate 50 is provided with a plurality of notches 53 for accommodating the anchor bars 44. Upon placement of the traffic surface slab, the semi-liquid concrete material is able to flow around the anchor bars 44 and through notches 53 so as to pass behind the plate 50 and fill the space between the rear surface of the lower inclined surface 36 and the traffic facing surfaces of the webbing plate(s) 24 and connecting plate(s) 38 to an elevation generally equal to the finished height of the traffic surface slab, whereby the lower inclined surface becomes firmly embedded in the traffic surface 30 upon curing of the concrete.

Apertures 52 are also provided in stiffening ribs 26, 28 to enable engagement of the barrier module by grappling hooks or similar engaging means of a suitable material handling apparatus such as crane or the like.

Figure 3:
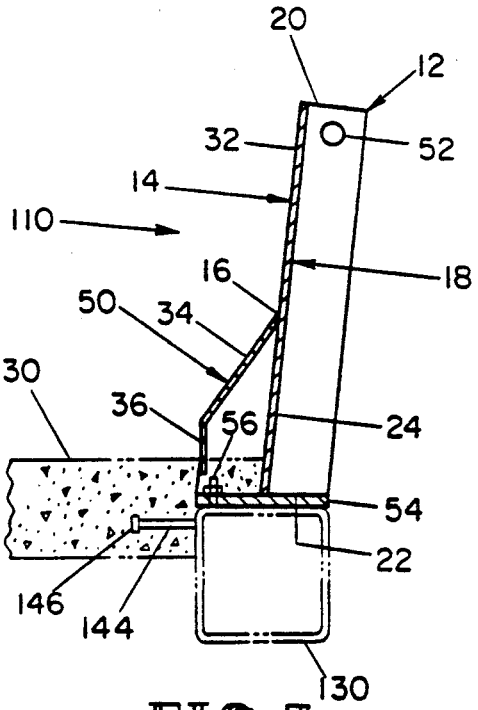
FIG. 3 is a cross sectional view similar to FIG. 1 showing a further embodiment of a modular steel traffic barrier element of the present invention connected to steel beam structure and deck concrete of a bridge deck.
Figure 4:
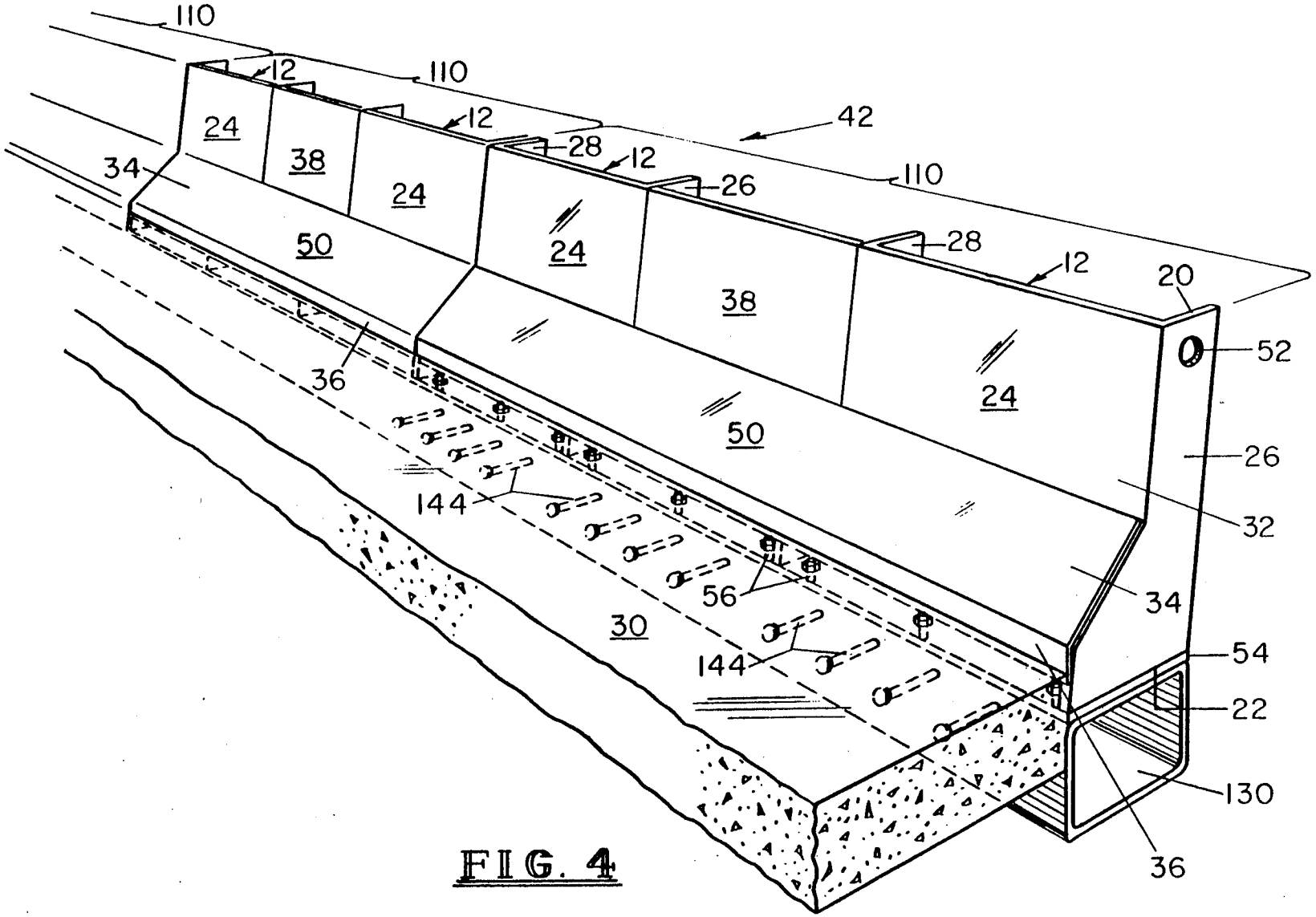
FIG. 4 is a perspective view of the construction shown in FIG. 3.

Turning to FIGS. 3 and 4, wherein like references indicate similar elements to those thus far described, as is true in the remaining views, there is shown another embodiment of a traffic barrier module in accordance with the present invention, herein designated by reference numeral 110. Module 110 is similar in most regards to module 10 except, primarily, for the structure and manner by which it is attached to the roadway structure, which in this scenario is that of a bridge deck formed of a concrete traffic surface slab 30 and a metallic box beam 130.

In this particular embodiment, the metallic box beam 130 rather than the module 10 is provided with anchoring bars for embedment in the concrete slab traffic surface 30. The anchoring bars, indicated by numeral 144 are preferably provided with enlarged heads 146 in order to permit secure anchoring of the beam 130 to the traffic surface. Further according to this particular embodiment, the modified I-beam section 12 of the barrier module 110 has welded to the bottom surface 22 thereof an attachment plate 54. Attachment plate 54, which can extend substantially the entire length of the module 110, enables the module to be fastened by suitable means such as nut and bolt fasteners 56 to beam 130 prior to placement of the material which ultimately hardens to form traffic surface 30. It will be understood, however, that any suitable fastening means such as, for example, rivets or welding, can also be used to fasten the modules 110 to the box beam 130.

Figure 5:
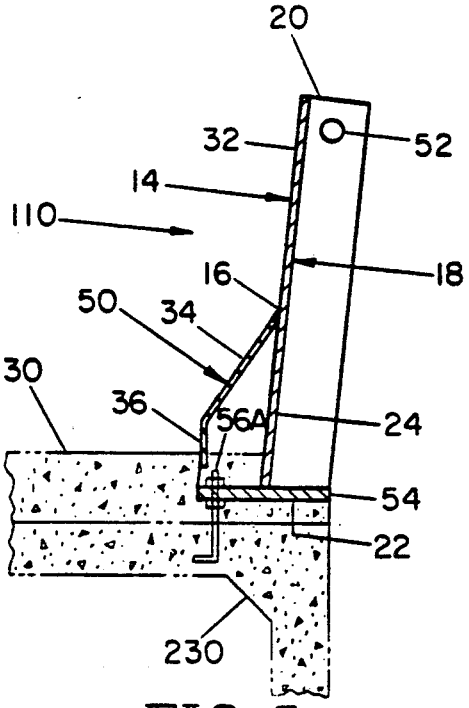
FIG. 5 is an cross sectional view similar to FIG. 3 showing the modular steel traffic barrier element of the present invention connected to a prestressed concrete box beam of a bridge superstructure.
Figure 6:
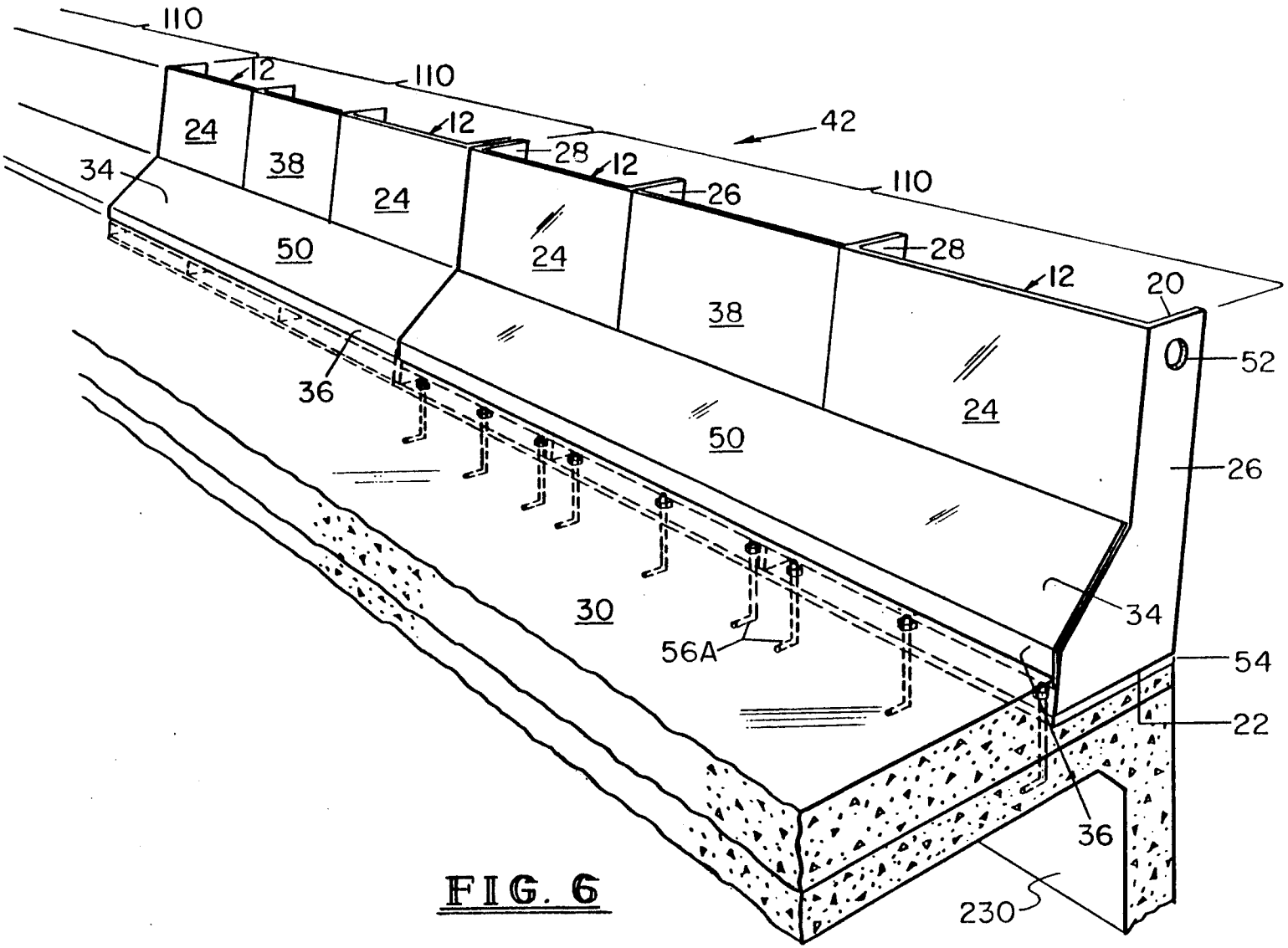
FIG. 6 is a perspective view of the construction shown in FIG. 5.

FIGS. 5 and 6 depict an embodiment of the present invention wherein the barrier module is essentially identical to the barrier module shown in FIGS. 3 and 4, hence it also bears the reference numeral 110. The barrier module 110 in FIGS. 5 and 6, however, is attached by suitable threaded fasteners 56A which are embedded in and extend upwardly from a prestressed concrete box beam 230 of a bridge superstructure. Once the selected number of barrier modules 110 are attached to the concrete box beam 230, the material forming traffic surface 30 is poured and cured to form a trafficable slab.

Figure 7:
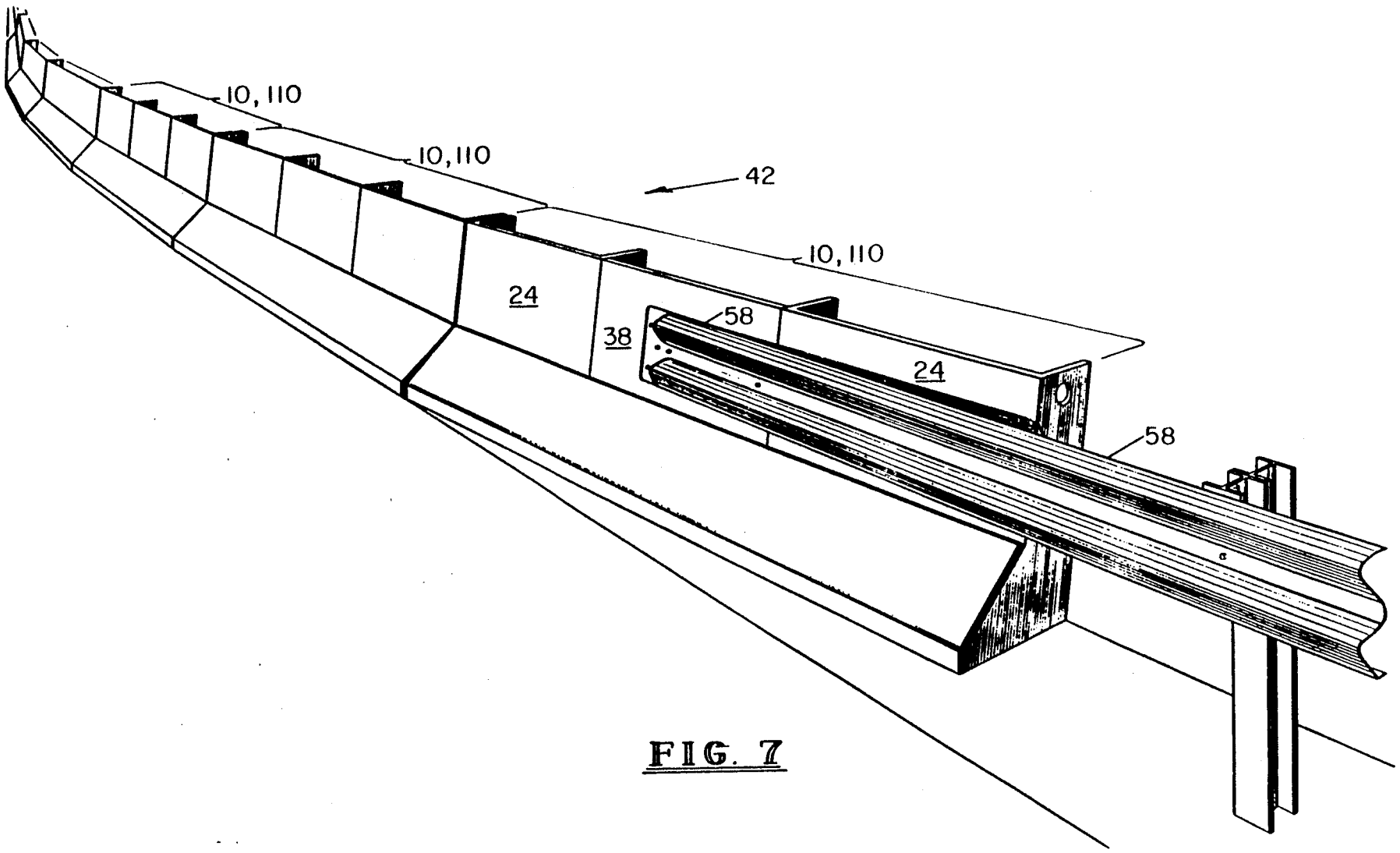
FIG. 7 is a perspective view of roadway curving to the right, with the roadway structure supporting several modular steel traffic barriers of the present invention as well as the connection of a terminal one of the traffic barriers to a conventional highway guide rail.

FIG. 7 illustrates an example of the manner in which a terminal one of the traffic barrier modules of an elongated traffic barrier 42 constructed according to the present invention may be attached to a conventional metallic guide rail assembly. As is known, highway guide rails are commonly connected to terminal barrier modules of conventional New Jersey barrier structures in order to provide a substantially continuous protective traffic directing construction adjacent one or both sides of a roadway structure or as a median dividing traffic lanes thereof. When forming such a connection, a free end of a guide rail, such as guide rail 58 in FIG. 7 (which is provided with a number of fastener receiving holes), is typically fastened using bolt type fasteners or the like to the terminal barrier module.

In the manufacture of conventional concrete barrier modules that are to be connected to guide rails, the concrete of the barrier module must be provided with internally threaded fastener receiving inserts which are embedded in the concrete in a predetermined pattern and through which the fasteners can pass for securement of the guide rail to the barrier module. Such a construction requires that substantial attention be exercised in establishing the proper initial orientation of the internally threaded inserts and thereafter maintaining such orientation during pouring of the barrier concrete as well as during the early stages of the subsequent concrete curing process.

Barrier modules 10 or 110 (or module 210 to be described hereinbelow) constructed according to the present invention, however, require no internally threaded inserts. Hence, the desired predetermined hole pattern for receiving the fasteners for joining the guide rail to the module can be rapidly and simply achieved using drills of standard power fitted with standard length drill bits adapted for drilling metal, thereby resulting in simpler manufacture and reduced fabrication costs resulting from the elimination of the threaded inserts. Moreover, although shown as being attached to the connecting plate 38 of the terminal barrier module, the guide rail 58 may also be suitably attached to either of the webbing plates 24 of the modified I-beam sections as determined by the selected locations of the guide rail fastener receiving holes.

Figure 8:
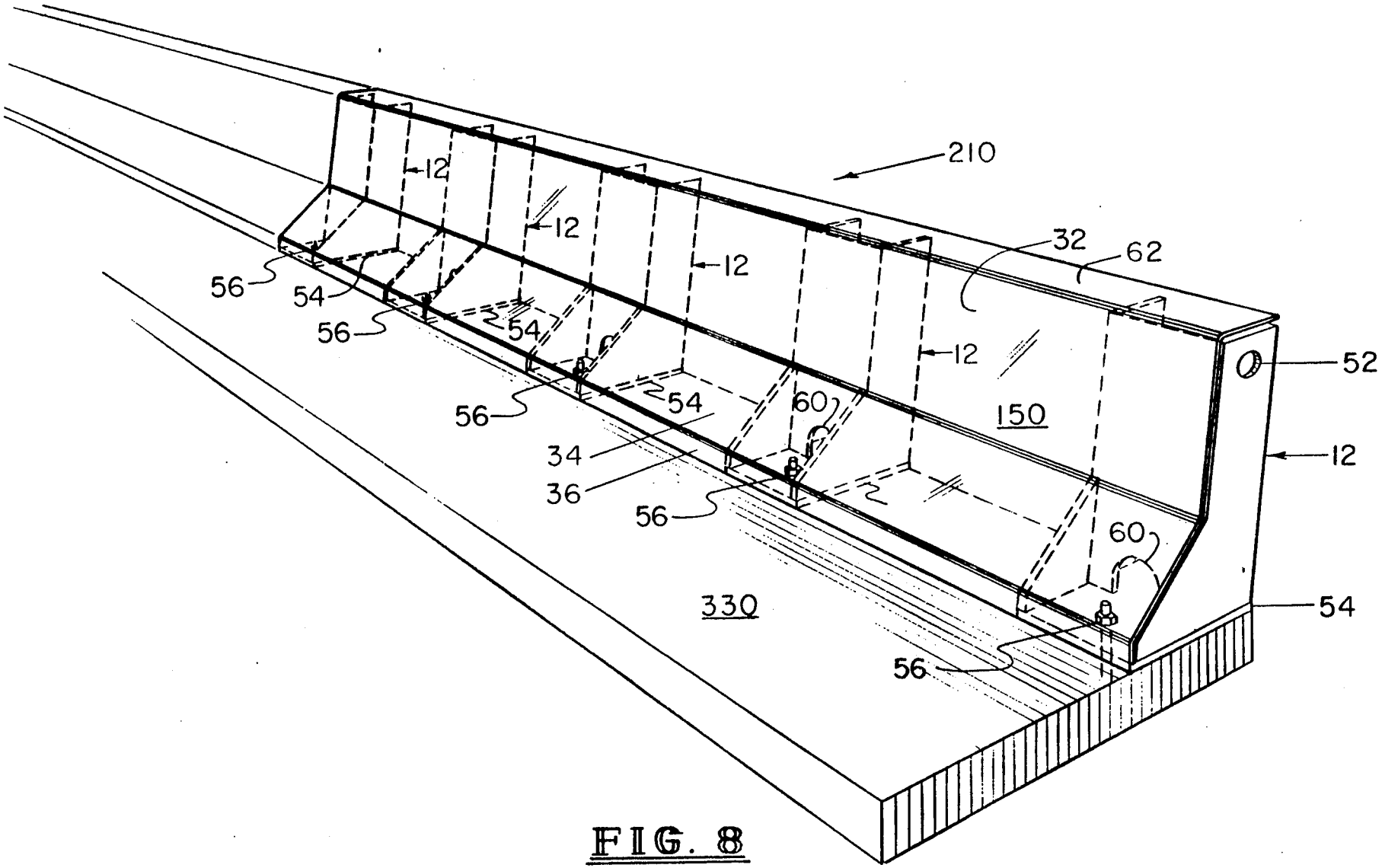
FIG. 8 is a perspective view of a further embodiment of the present invention connected to the top of a bridge deck.

Turning to FIG. 8, there is shown another traffic barrier module constructed in accordance with the present invention and designated by reference numeral 210. Barrier module 210 in this example comprises five modified I-beam elements or sections 12 (although there could be more or less) which are individually attached through their respective attachment plates 54 via fastener members 56 to a roadway structure 330, such as a timber, precast concrete or steel bridge deck. Apertures 60 are provided in the webbing plates of each of the I-beam sections 12 in order to permit passage therethrough of a suitable tool for inserting and/or tightening fasteners 56.

Further in accordance with this particular embodiment there is provided a modified cover means or bent plate 150 which is preferably welded to sections 12 and extends for substantially the entire length of the barrier module 210. The bent plate 150 defines not only the intermediate and lower inclined surfaces 34 and 36 but also the upper inclined surface 32. Furthermore, it provides a top cover surface 62 for additional strength and protection of the barrier module. It will be understood that a similar bent plate can be provided in the earlier described barrier modules 10 and 110 in place of the bent plate 50 and the connecting plates 38, and vice versa.

Although shown and described in the preferred embodiments as being used for traffic barriers at the sides of a roadway structure, any of the barrier modules 10, 110 or 210 described herein may be suitably adapted for positioning between adjacent lanes of traffic so as to act as a lane divider or median. And, if so used, it is preferred that the barrier elements be positioned back-to-back, i.e., non-traffic facing side to non-traffic facing side, so that both lanes of traffic will be afforded the known safety benefits of the New Jersey barrier profile configuration while providing the barrier with an aesthetically pleasing, symmetrical construction.

Through the use of off-the-shelf materials for the I-beam sections 12 and plates 50 and 150, the barrier modules 10, 110 and 210 can be inexpensively and rapidly manufactured to virtually any design specification requirements, including, but not limited to, dimensional and strength requirements. The modules typically possess greater impact strength and durability than their concrete counterparts, they are lighter in weight (and therefore more easily handled and installed) and they are narrower than known New Jersey barrier, thereby affording easier storage and the ability to design narrower roadway structures at reduced construction material cost. Moreover, the components of the barrier modules can be composed of corrosion resistant steels and/or coated with known anti-corrosion coatings for enhancing service life. The smooth surface of the steel at the traffic facing side 14 of the modules offers to a vehicle in collision therewith a surface having a lesser coefficient of friction than that of a conventional concrete New Jersey traffic barrier. Consequently, the rate of deceleration of the impacting vehicle is reduced and the barrier's ability to redirect the impacting vehicles into the direction of traffic is enhanced.

Further, although it is at present most preferred that the barrier modules 10, 110, 210 be formed of sections of modified, off-the-shelf I-beams, it is also possible that individual substantially parallel steel plate members adapted to serve as stiffening plates and having the appropriate New Jersey barrier profile or profiles may be affixed to a steel spinal or webbing plate extending substantially perpendicularly therebetween so as to form an alternative to the modified I-beams 12.

Although the invention has been described in detail for the purpose of illustration, it is to be understood that such detail is solely for that purpose and that variations can be made therein by those skilled in the art without departing from the spirit and scope of the invention except as it may be limited by the claims.

I claim:

1. A barrier element comprising:

a webbing plate;

stiffening plates affixed along opposite edges of and substantially perpendicular to said webbing plate, said stiffening plates and said webbing plate presenting on at least one side of said barrier element a profile having a plurality of inclined surfaces; and cover plate means spanning said webbing plate and affixed to said stiffening plates for defining at least one of said inclined surfaces.

2. The barrier element of claim 1 wherein said webbing plate, said stiffening plates and said cover plate means are formed of steel.

3. The barrier element of claim 1 wherein said profile conforms substantially to that of a traffic facing surface of a New Jersey traffic barrier element.

4. The barrier element of claim 1 wherein said webbing plate and stiffening plates are components of an I-beam that is modified to produce said profile.

5. The barrier element of claim 1 wherein said cover plate means comprise a bent plate defining a plurality of said inclined surfaces.

6. The barrier element of claim 1 further comprising means for anchoring said barrier element to a roadway structure.

7. The barrier element of claim 6 wherein said means for anchoring comprise a plurality of spaced-apart anchoring bars carried along a lower portion of said barrier element and adapted for embedment in curable material forming a trafficable surface of said roadway structure.

8. The barrier element of claim 7 wherein said plurality of anchoring bars extend substantially perpendicularly to said webbing plate and are provided with enlarged heads on free ends thereof.

9. The barrier element of claim 8 wherein said anchoring means further comprise a linking bar secured to said anchoring bars and extending generally parallel to a longitudinal axis of said barrier element.

10. The barrier element of claim 6 wherein said means for anchoring comprise attachment plate means affixed to a bottom surface of said barrier element and means for fastening said attachment plate to said roadway structure.

11. The barrier element of claim 5 further comprising means for anchoring said barrier element to a roadway structure.

12. The barrier element of claim 4 wherein said means for anchoring comprise a plurality for spaced-apart anchoring bars carried along a lower portion of said barrier element and adapted for embedment in curable material forming a trafficable surface of said roadway structure.

13. The barrier element of claim 12 wherein said bent plate includes a plurality of notches adapted to accommodate said plurality of spaced-apart anchoring bars whereby said material can flow around said anchoring bars and through said notches so as to pass behind said bent plate, thereby embedding said bent plate in said material upon curing thereof.

14. A traffic barrier module comprising:

a plurality of barrier elements each comprising a webbing plate, stiffening plates affixed along opposite edges of and substantially perpendicular to said webbing plate, said stiffening plates and said webbing plate presenting on at least one side of said barrier element a profile having a plurality of inclined surfaces;

connecting plate means positioned between and connecting pairs of said plurality of barrier elements; and cover plate means spanning said webbing plates and said connecting plate means and affixed to said stiffening plates for defining at least one of said inclined surfaces.

15. The traffic barrier module of claim 14 wherein said connecting plate means extend substantially coplanar with said webbing plates of said barrier elements connected thereto.

16. The traffic barrier module of claim 15 wherein said connecting plate means is of substantially the same height as said webbing plates of said barrier elements connected thereto.

17. The traffic barrier module of claim 14 wherein said webbing plates, said stiffening plates, said cover plate means and said connecting plate means are formed of steel.

18. The traffic barrier module of claim 14 wherein said profile conforms substantially to that of a traffic facing surface of a New Jersey traffic barrier element.

19. The traffic barrier module of claim 14 wherein said webbing plates and said stiffening plates of said barrier elements are components of I-beams that are modified to produce said profile.

20. The traffic barrier module or claim 14 wherein said cover plate means comprise a bent plate defining a plurality of said inclined surfaces.

21. The traffic barrier module of claim 14 further comprising means for anchoring said barrier module to a roadway structure.

22. The traffic barrier module of claim 21 wherein said means for anchoring comprise a plurality of spaced-apart anchoring bars carried along a lower portion of said barrier module and adapted for embedment in curable material forming a trafficable surface of said roadway structure.

23. The traffic barrier module of claim 22 wherein said plurality of anchoring bars extend substantially perpendicular to said webbing plates and are provided with enlarged heads on free ends thereof.

24. The traffic barrier module or claim 23 wherein said anchoring means further comprise a linking bar secured to said anchoring bars and extending generally parallel to the longitudinal axis of the barrier module.

25. The barrier module of claim 21 wherein said means for anchoring comprise attachment plate means affixed to a bottom surface of said barrier module and means for fastening said attachment plate to said roadway structure.

26. The traffic barrier module of claim 20 further comprising means for anchoring said barrier module to a roadway structure.

27. The traffic barrier module of claim 26 wherein said means for anchoring comprise a plurality of spaced-apart anchoring bars carried along a lower portion of said barrier module and adapted for embedment in curable material forming a trafficable surface of said roadway structure.

28. The traffic barrier module of claim 27 wherein said bent plate includes a plurality of notches adapted to accommodate said plurality of spaced-apart anchoring bars whereby said material can flow around said anchoring bars and through said notches so as to pass behind said bent plate, thereby embedding said bent plate in said material upon curing thereof.

29. A method of constructing a barrier element comprising the steps of:

(a) providing a webbing plate having stiffening plates along opposite edges thereof, said stiffening plates extending substantially perpendicular to said webbing plate and presenting on at least one side of said barrier element a profile having a plurality of inclined surfaces; and (b) affixing a cover plate to said stiffening plates for defining at least one of said inclined surfaces, said cover plate spanning said webbing plates.

30. The method of claim 29 further comprising providing means for anchoring said barrier element to a roadway structure.

31. The method of claim 29 wherein step (a) comprises modifying an I-beam to produce said profile.

32. A method of constructing a barrier module comprising the steps of:

(a) providing a plurality of barrier elements each comprising a webbing plate having stiffening plates along opposite edges thereof, said stiffening plates extending substantially perpendicular to said webbing plate and presenting on at least one side of said barrier element a profile having a plurality of inclined surfaces; and (b) affixing connecting plate means between pairs of said plurality of barrier elements; and (c) affixing a cover plate to said stiffening plates for defining at least one of said inclined surfaces, said cover plate spanning said webbing plates and said connecting plate means.

33. The method of claim 32 further comprising providing means for anchoring said barrier module to a roadway structure.

34. The method of claim 32 wherein step (a) comprises modifying an I-beam to produce said profile.

35. A roadway structure comprising:

(a) a trafficable roadway surface; and (b) at least one traffic barrier module anchored to said roadway surface, said at least one traffic barrier module comprising:

a plurality of barrier elements each having a webbing plate, stiffening plates affixed along opposite edges of and substantially perpendicular to said webbing plate, said stiffening plates and said webbing plate presenting on at least one side of said barrier element a profile having a plurality of inclined surfaces;

connecting plate means positioned between and connecting pairs of said plurality of barrier elements; and cover plate means spanning said webbing plates and said connecting plate means and affixed to said stiffening plates for defining at least one of said inclined surfaces.

36. The roadway structure of claim 35 wherein said trafficable surface is a bridge deck.

37. The roadway structure of claim 35 wherein said trafficable surface is a highway surface.

38. The roadway structure of claim 35 wherein said trafficable surface is a manufacturing plant floor surface.

* * * * *